US007607794B1

(12) United States Patent
Thompson

(10) Patent No.: US 7,607,794 B1
(45) Date of Patent: Oct. 27, 2009

(54) RECESSED WALL-WASH KICK REFLECTOR

(75) Inventor: Paul Thompson, Ecru, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 173 days.

(21) Appl. No.: 11/465,609

(22) Filed: Aug. 18, 2006

(51) Int. Cl.
*F21S 6/00* (2006.01)

(52) U.S. Cl. ..... 362/147; 362/150

(58) Field of Classification Search ..... 362/145–148, 362/150
See application file for complete search history.

(56) References Cited

U.S. PATENT DOCUMENTS

| | | | | |
|---|---|---|---|---|
| 2,465,248 | A | | 3/1949 | McCandless |
| 2,647,202 | A | | 7/1953 | Elmer |
| 2,716,185 | A | | 8/1955 | Burliuk et al. |
| 2,739,226 | A | | 3/1956 | Rex |
| 2,998,511 | A | | 8/1961 | Chan |
| 3,375,368 | A | | 3/1968 | Dorsky |
| 3,381,123 | A | | 4/1968 | Docimo |
| 3,518,420 | A | | 6/1970 | Kripp |
| 3,600,569 | A | * | 8/1971 | Matteson ..... 362/311 |
| 3,675,007 | A | | 7/1972 | Appleton et al. |
| 3,721,817 | A | | 3/1973 | Contratto |
| 4,039,822 | A | | 8/1977 | Chan et al. |
| 4,066,887 | A | | 1/1978 | Levis |
| 4,086,480 | A | | 4/1978 | Lahm |
| 4,177,504 | A | | 12/1979 | Henderson, Jr. et al. |
| 4,207,607 | A | | 6/1980 | Gulliksen |
| 4,213,171 | A | | 7/1980 | Sassmannshausen |
| 4,229,782 | A | | 10/1980 | Ruud et al. |
| 4,231,080 | A | | 10/1980 | Compton |
| 4,232,361 | A | | 11/1980 | Kelsall |
| 4,274,615 | A | | 6/1981 | Chan et al. |
| 4,313,154 | A | | 1/1982 | Capostagno et al. |
| 4,327,403 | A | | 4/1982 | Capostagno et al. |
| 4,337,506 | A | | 6/1982 | Terada |
| 4,344,111 | A | | 8/1982 | Ruud et al. |
| 4,382,274 | A | | 5/1983 | De Backer et al. |
| 4,386,392 | A | | 5/1983 | Reibling |
| 4,388,675 | A | | 6/1983 | Lewin |
| 4,408,262 | A | | 10/1983 | Kusmer |
| 4,428,038 | A | | 1/1984 | Rakitsch et al. |
| 4,475,147 | A | | 10/1984 | Kristofek |
| 4,518,896 | A | | 5/1985 | Milles, Jr. |
| 4,519,019 | A | | 5/1985 | Hall |
| 4,551,791 | A | | 11/1985 | Salansky |
| 4,564,888 | A | | 1/1986 | Lewin et al. |
| 4,623,956 | A | | 11/1986 | Conti |
| 4,625,267 | A | | 11/1986 | Mikalonis |
| 4,630,895 | A | | 12/1986 | Abdala, Jr. et al. |
| 4,635,172 | A | | 1/1987 | Steinke |
| 4,646,212 | A | | 2/1987 | Florence |

(Continued)

*Primary Examiner*—Jong-Suk (James) Lee
*Assistant Examiner*—Julie A Shallenberger
(74) *Attorney, Agent, or Firm*—Middleton & Reutlinger; John F. Salazar

(57) ABSTRACT

The invention comprises a completely recessed wall-wash lighting fixture capable of being installed within a ceiling. The lighting fixture comprises a housing, which contains a lamp. The invention may comprise a lighting fixture further comprises a reflector disposed within the housing and adjacent to the first end of the housing. The invention may also comprise a flared lamp shield attached to the housing, which is capable of protecting the lighting fixture from damage. The lamp shield extends below the ceiling when the lighting fixture is installed.

7 Claims, 3 Drawing Sheets

U.S. PATENT DOCUMENTS 4,703,406 A 10/1987 Elliott et al.
4,704,664 A 11/1987 McNair
4,712,168 A 12/1987 Scherrer
4,729,080 A 3/1988 Fremont et al.
4,742,440 A 5/1988 Guzzini
4,748,543 A * 5/1988 Swarens ..... 362/147
4,760,505 A 7/1988 Cole, Jr.
4,856,103 A 8/1989 Compton
4,866,584 A 9/1989 Plewman
4,872,097 A 10/1989 Miller
4,930,054 A 5/1990 Krebs
4,943,901 A 7/1990 Baldwin et al.
4,954,935 A 9/1990 Hammond et al.
5,010,458 A 4/1991 Fraizer
5,031,084 A 7/1991 Russo et al.
5,032,959 A 7/1991 Brass
5,045,985 A 9/1991 Russo et al.
5,086,375 A 2/1992 Fabbri et al.
5,124,901 A 6/1992 Sojka et al.
5,130,914 A 7/1992 Bengochea
5,140,301 A 8/1992 Watanabe
5,142,459 A 8/1992 Swarens et al.
5,146,248 A 9/1992 Duwaer et al.
5,146,393 A 9/1992 Crane
5,199,782 A 4/1993 Johnson et al.
5,217,299 A 6/1993 Yoshida et al.
5,236,157 A 8/1993 Reggiani
5,251,116 A 10/1993 Wijbenga et al.
5,291,381 A 3/1994 Price
5,335,151 A 8/1994 Dahlberg
5,373,431 A 12/1994 Hayman et al.
5,375,045 A 12/1994 Ruud et al.
5,379,195 A 1/1995 Epstein
5,416,683 A 5/1995 McCarthy
5,416,684 A 5/1995 Pearce
5,426,575 A 6/1995 Richards
5,434,765 A 7/1995 Kelly et al.
5,438,495 A 8/1995 Ahlen et al.
5,440,471 A 8/1995 Zadeh
5,457,617 A 10/1995 Chan et al.
5,486,989 A 1/1996 Compton
5,493,483 A 2/1996 Lake
5,526,248 A 6/1996 Endo
5,562,343 A 10/1996 Chan et al.
5,582,479 A 12/1996 Thomas et al.
5,584,575 A 12/1996 Fickel
5,658,067 A 8/1997 Engle et al.
5,662,413 A 9/1997 Akiyama
5,673,997 A 10/1997 Akiyama
5,676,448 A 10/1997 Urbaing
5,707,143 A 1/1998 Hentz
5,725,302 A 3/1998 Sirkin
5,743,627 A 4/1998 Casteel
5,758,959 A 6/1998 Sieczkowski
5,791,768 A 8/1998 Splane, Jr.
5,800,050 A 9/1998 Leadford
5,813,744 A 9/1998 Altebarmakian
5,816,694 A 10/1998 Ideker et al.
5,826,970 A 10/1998 Keller et al.
5,836,678 A 11/1998 Wright et al.
5,851,061 A 12/1998 Hegarty
5,857,766 A 1/1999 Sieczkowski
D412,040 S 7/1999 Hudak et al.
5,957,573 A 9/1999 Wedekind et al.
5,967,363 A 10/1999 Allen
5,977,694 A 11/1999 McGuire
6,000,818 A 12/1999 Caluori
6,004,011 A 12/1999 Sieczkowski
6,019,477 A 2/2000 Wegrzyn et al.
6,027,231 A 2/2000 Fouke
6,033,093 A 3/2000 Latsis et al.
6,036,338 A 3/2000 Gordin
6,042,251 A 3/2000 McCarthy et al.
6,045,232 A 4/2000 Buckmaster
6,050,708 A 4/2000 Roorda
D425,221 S 5/2000 Burns
6,062,704 A 5/2000 Holder
6,082,031 A 7/2000 Heaton et al.
6,095,669 A 8/2000 Cho
6,095,671 A 8/2000 Hutain
6,116,749 A 9/2000 Quiogue et al.
RE36,908 E 10/2000 Ling
6,126,300 A 10/2000 Lee
6,164,802 A 12/2000 Gromotka
D437,077 S 1/2001 Minissi et al.
6,168,294 B1 1/2001 Erni et al.
6,170,967 B1 1/2001 Usher et al.
6,174,069 B1 1/2001 Plunk et al.
6,217,197 B1 4/2001 Siminovitch et al.
6,250,776 B1 6/2001 Burkitt et al.
6,283,430 B1 9/2001 Schubert et al.
6,350,047 B1 2/2002 Ng et al.
6,364,152 B1 4/2002 Poslinski et al.
6,371,630 B1 4/2002 Unger
6,425,680 B1 7/2002 Rippel et al.
6,447,145 B1 9/2002 Thomas et al.
6,478,453 B2 11/2002 Lammers et al.
6,478,454 B1 11/2002 Jaffari et al.
6,554,457 B1 4/2003 Platt
6,561,670 B1 5/2003 Jongewaard et al.
6,619,821 B1 9/2003 Waycaster
6,632,006 B1 10/2003 Rippel et al.
6,655,813 B1 12/2003 Ng
6,723,588 B2 4/2004 Kim
6,942,364 B1 9/2005 Wegner et al.
6,969,181 B1 11/2005 Bailey et al.
2005/0227536 A1 10/2005 Gamache et al.

* cited by examiner

RECESSED WALL-WASH KICK REFLECTOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a recessed wall wash lighting fixture. More particularly, the invention relates to a recessed wall wash lighting fixture having a kick reflector allowing the lighting fixture to light an adjacent wall from top to bottom.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE DRAWINGS

While this invention is capable of embodiments in many different forms, multiple embodiments are shown in the figures and will be herein described in detail. The present disclosure is to be considered an exemplification of the principles of the invention and is not intended to limit the broad aspects of the invention to the embodiments illustrated.

Figure 1:
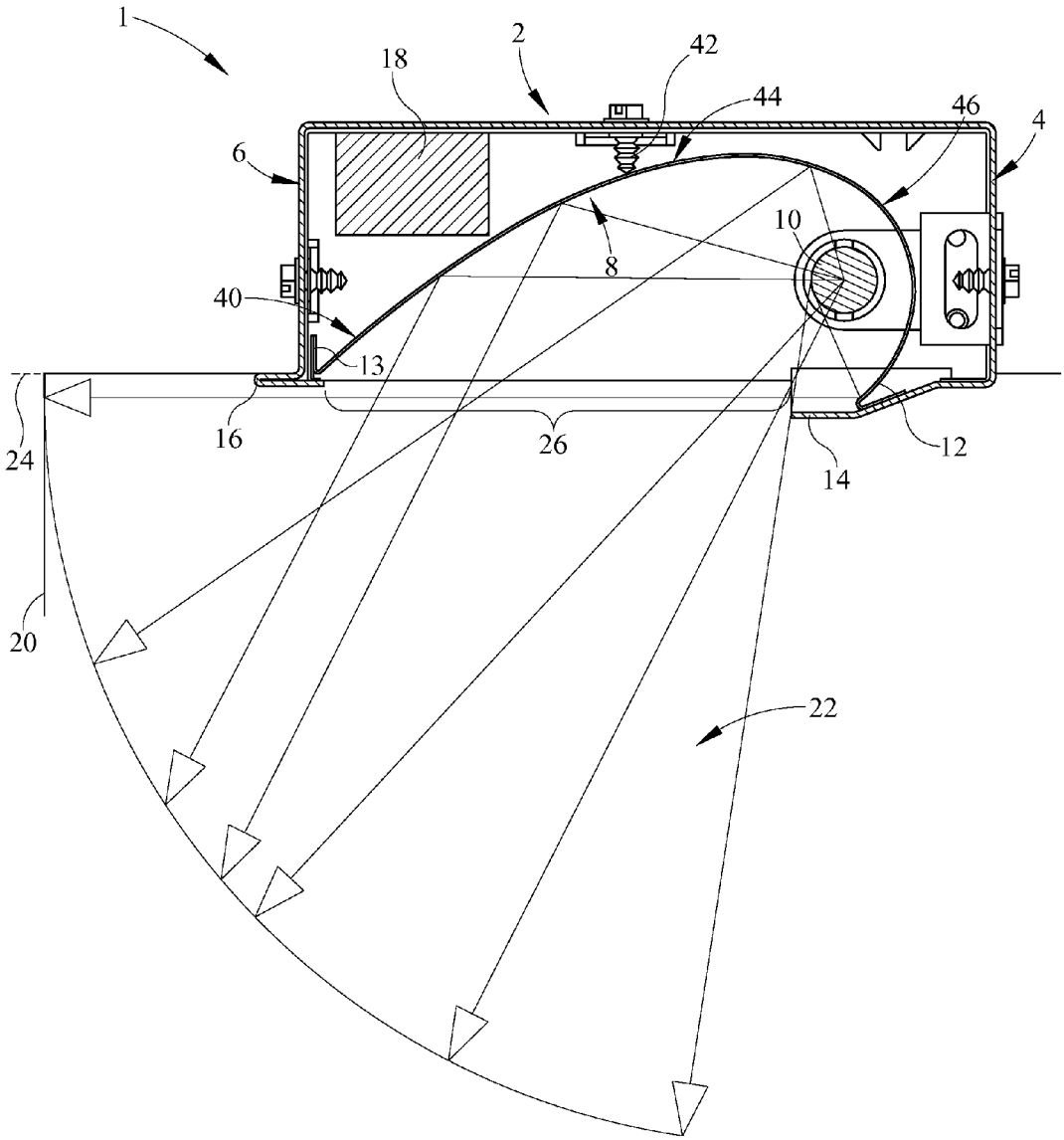
FIG. 1 is a side view of a lighting fixture of the invention and a wall to be lit by the invention.

Referring now to the drawings and specifically to FIG. 1, a completely recessed wall-wash lighting fixture 1 comprises a housing 2 having a first end 4 and a second end 6. The lighting fixture 1 is "completely recessed" because when the fixture 1 is properly installed, the first end 4 and second end 6 of the housing 2 are above the ceiling line 24 of the ceiling 16 into which the fixture 1 is placed, as shown in FIG. 1.

When the fixture 1 is installed, the second end 6 should be adjacent to and abutting the wall 20 to be lit, with the first end 4 opposite the wall 20. Positioned within the housing 2 is a lamp 10 and a reflector 8. The lamp 10 is situated closer to the first end 4 of the housing 2, and the reflector 8 surrounds the lamp 10 and kicks light out in a wall-wash effect through the exit aperture 26 of the housing 2. The lamp 10 can be a T5 type fluorescent lamp, but other suitable lamps can be used. The reflector 8 is held in place within the housing 2 by tension and has at a first end 46 a first V-shaped edge 12 which is positioned directly below the lamp 10. The second V-shaped edge 13 of the reflector 8 compresses against a flared lamp shield 14 of the second end 6 of the housing 2 and is held in place there through tension and compression. No mechanical structures retain or hold the second V-shaped edge 13 or first V-shaped edge 12 in place, but instead, the reflector 8 is held in position through the tension and friction of the reflector 8 of the housing 2 and screw 42.

The first V-shaped edge 12 of the reflector 8 stretches down past the ceiling line 24 where it is adjacent to and held in place by a flared lamp shield 14, which projects from the first end 4 of the housing 2 toward the wall 20 to be lit by the lamp 10. The flared lamp shield 14 protects the reflector 8 from being damaged by projectiles and supports the first V-shaped edge 12 so that the reflector 8 is not inadvertently adjusted. The first V-shaped edge 12, the screw 42, and the second V-shaped edge 13 hold the reflector 8 securely in place.

The location of the first V-shaped edge 12 below the ceiling line 24 allows the reflector 8 to project light at the top of the adjacent wall 20. As seen in FIG. 1, the lighted area 22 includes the intersection of the wall 20 and the ceiling 16. The design of the reflector 8 is such that it kicks light out for a wall wash effect from the light emitting aperture 26 of the housing 2.

More particularly, as shown in FIG. 1, the reflector 8 has a unique shape that allows the wall 20 to be covered in light from top to bottom. A first end 46 of the reflector 8 opposite the wall 20 is dramatically curved such that it is substantially circular and deflects light downward and toward the wall 20. The first end 46 starts above the lamp 10 and curves downward around and past the lamp 10 until it terminates in the first V-shaped edge 12. The first V-shaped edge 12 is positioned below the ceiling line 24 and lodges against the flared lamp shield 14 of the housing 2 so that it reflects light back toward the wall 20. The reflector 8 also has a sloped middle 44 and substantially linear second end 40 that is attached to the second V-shaped edge 13. Every part of the reflector 8 forces light away from the first end 4 of the housing 2 and toward the wall 20, as is demonstrated in FIG. 1. Although some of the light from the lamp 10 is reflected on to the floor, that is not its primary purpose, and it is not designed to properly light any part of the room in which the lighting fixture 1 is placed except for the wall.

Figure 2:
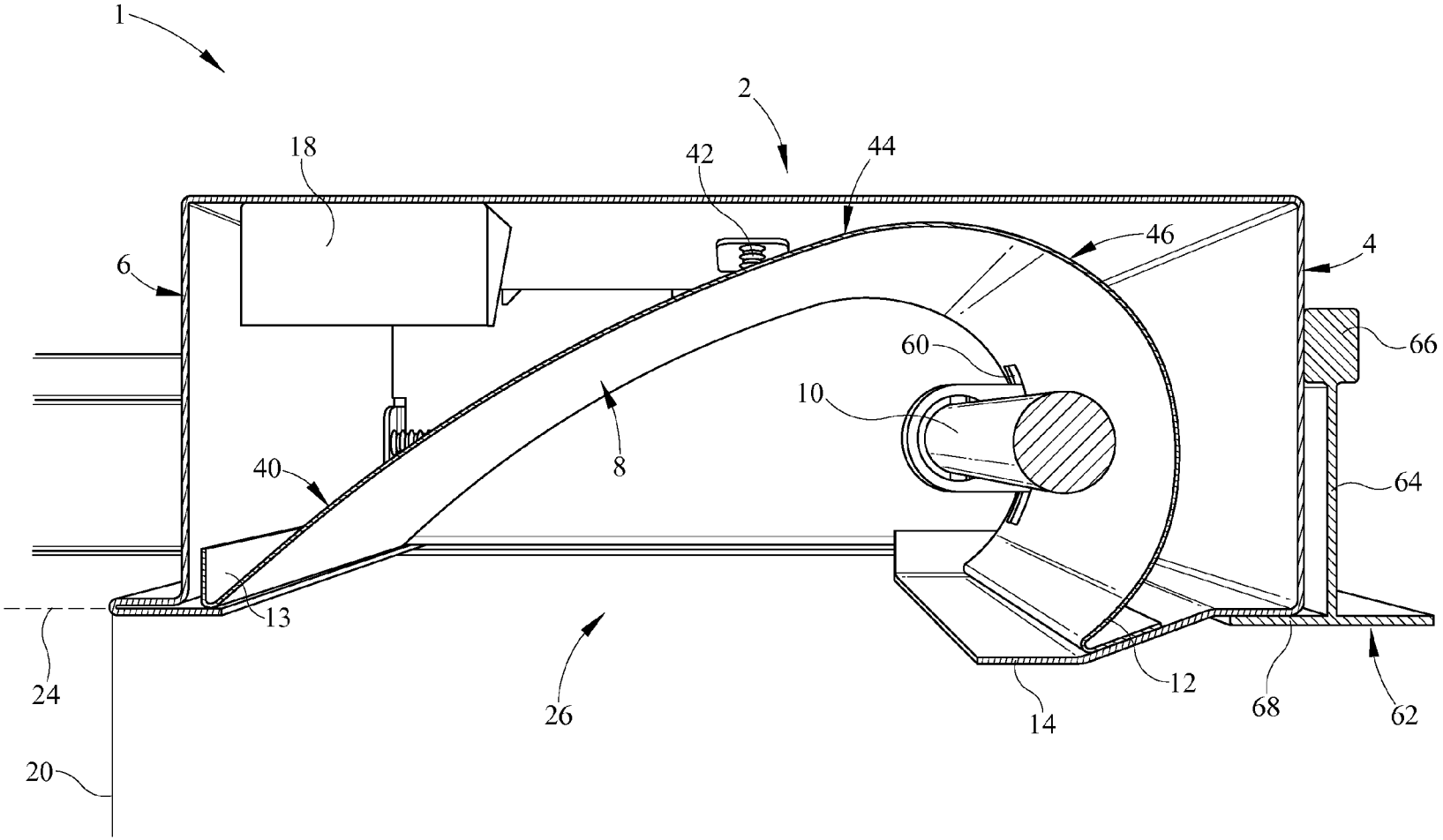
FIG. 2 is a perspective view of the lighting fixture of the invention.
Figure 3:
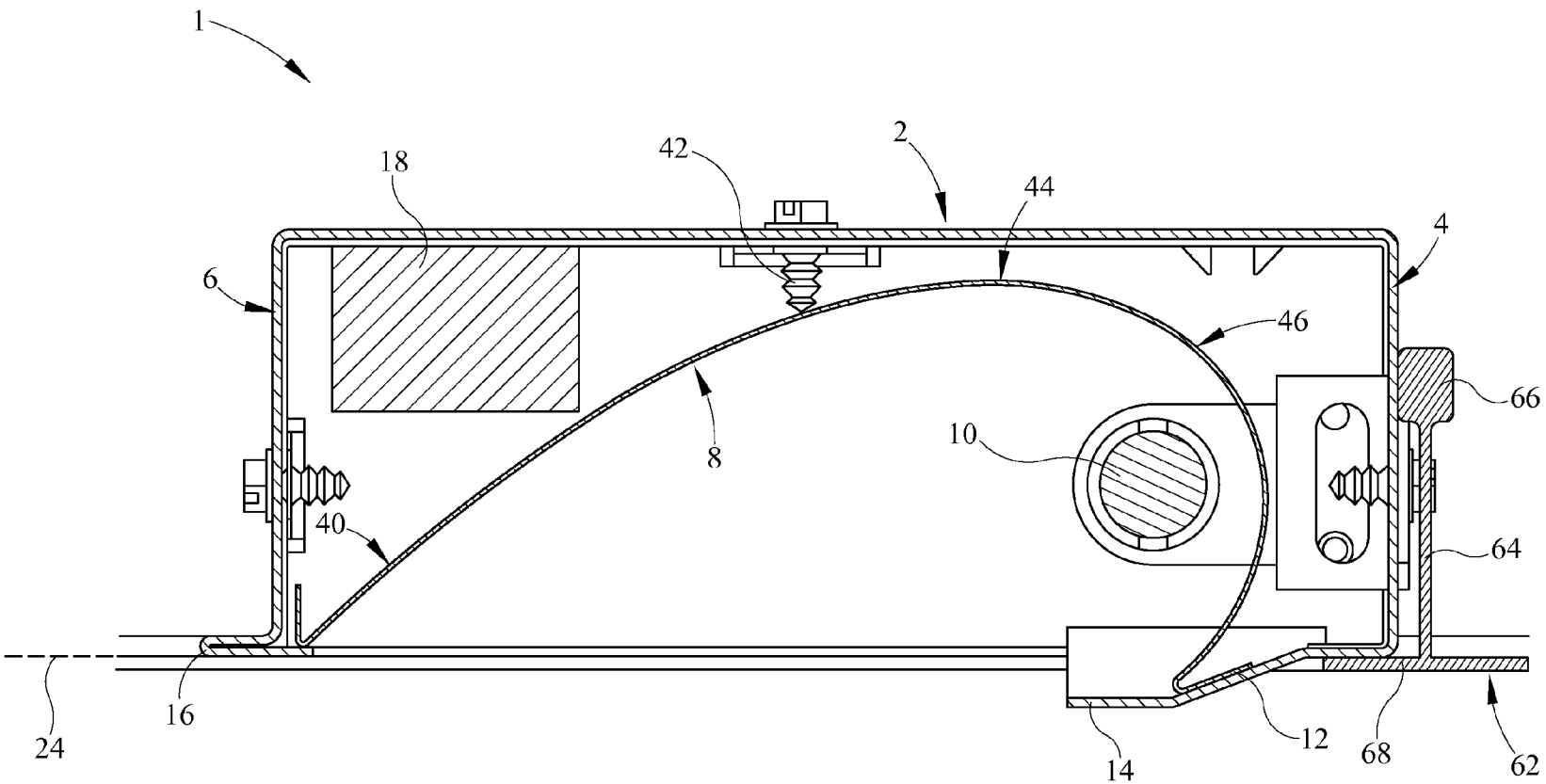
FIG. 3 is a side view of the invention.

FIGS. 2 and 3 further illustrate embodiments of the invention. As shown in FIG. 2, the reflector of the invention stretches across the width of the housing so that the portion of the wall 20 adjacent to the housing 2 is covered with light. The reflector 8 comprises a first end 46 opposite the wall 20 that is dramatically curved such that it is substantially circular and deflects light downward and toward the wall 20. The first end 46 starts above the lamp 10 and curves downward around and past the lamp 10 until it terminates in the first V-shaped edge 12. The first V-shaped edge 12 is positioned below the ceiling line 24 and lodges against the flared lamp shield 14 of the housing 2 so that it reflects light back toward the wall 20. The reflector 8 also has a sloped middle 44 and substantially linear second end 40 that is attached to the second V-shaped edge 13.

Every part of the reflector 8 forces light away from the first end 4 of the housing 2 and toward the wall 20, as is demonstrated in FIG. 2. Furthermore, as shown in FIG. 2, the flared lamp shield and the housing of the invention can be rectangular. As is also shown in FIGS. 1-3, the housing has room for a ballast 18 to power the lamp 10 of the invention To insert the light fixture 1 into the ceiling, the housing 2 slides into the t-grid of the ceiling, which is made up of two or more t-grids 62. As shown in FIG. 2, the housing 2 of the invention is supported by t-grid 62, which comprises a horizontal base 68, a thin middle portion 64, and a block 66. The first end 4 of the housing 2 is adjacent to the t-grid 62 and rests on the horizontal base 68. In one embodiment, clips attach to the first end 4 and fasten around block 66 so that the lighting fixture 1 is held tightly in place within the ceiling.

The reflector 8 shown in FIG. 2 also has an opening 60 through which arm 70 protrudes. Arm 70 is attached to lamp 10 and holds it in place within the housing 2 and underneath the sloped middle 44 of the reflector 8 so that light is reflected accurately toward the wall 20. The reflector 8 of the invention is typically inserted into the housing before lamp 10 is attached to the arm 70. In one embodiment, lamp 10 attaches to arm 70 through a threaded opening (not shown), but other fastening measures for attaching the lamp 10 are possible in other embodiments. When lamp 10 burns out, it can be replaced without removing the lighting fixture 1 from the ceiling if the user so desires.

In FIG. 3, as in the embodiment of the invention shown in FIG. 1, the V-shaped edge 42 of the reflector 50 stretches down past the ceiling line 24 where it is adjacent to a flared lamp shield 14, which projects from the first end 4 of the housing 2 toward the wall 20 to be lit by the lamp 10. The flared lamp shield 14 protects the reflector 50 from being damaged by projectiles and supports the V-shaped edge 42 so that the reflector 50 is not inadvertently adjusted. Screw 42 contacts the sloped middle 44 of reflector 8 and helps keep it in place.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

What is claimed is:

1. A recessed wall-wash lighting fixture capable of being installed within a ceiling and reflecting light to the joinder of the ceiling and an adjacent wall, said lighting fixture comprising:

a lamp;

a housing having a first end and a second end, wherein said lamp is positioned closer to said first end than said second end;

a one-piece reflector disposed within said rectangular housing and having an elliptical reflector section adjacent to said first end of said housing, wherein said elliptical reflector section extends below said ceiling when said lighting fixture is installed, said reflector also having a parabola section extending away from said elliptical reflector section and towards said second end;

a flared lamp shield attached to said first end of said housing and adjacent said elliptical reflector section, wherein said lamp shield and a lower edge section of said elliptical reflector section extends below said ceiling when said lighting fixture is installed above said ceiling, said lower edge section of said elliptical reflector section capabable of reflecting light at the joinder of the ceiling and the adjacent wall;

wherein said one-piece reflector is installed entirely behind said ceiling except for said lower edge section which extends below said ceiling to act as a kick reflector to reflect light to said joinder.

2. The lighting fixture of claim 1, wherein said elliptical reflector section has a V-shaped edge positioned below said ceiling line and lodges against said flared lamp shield of said housing.

3. A recessed wall-wash lighting fixture capable of being installed within a ceiling, said lighting fixture comprising:

a lamp;

a housing surrounding said lamp and having a first end and a second end, wherein said lamp is positioned closer to said first end than said second end;

a reflector substantially maintained within said housing and having an elliptical section surrounding said lamp and a parabola section extending from said elliptical section and extending towards said second end of said housing said elliptical section extending from above said lamp to below said lamp and terminating at a lower edge;

a flared lamp shield extending from said first end of said housing, wherein said flared lamp shield extends below said ceiling when said lighting fixture is installed while said housing of said recessed wall wash lighting fixture remains installed above said ceiling;

said lower edge of said elliptical section of said reflector extends downward below said lamp below said ceiling and above said flared lamp shield.

4. The lighting fixture of claim 3 wherein said reflector has a first V-shaped edge adjacent to said first end of said housing, said first V-shaped edge extends below said ceiling when said lighting fixture is installed.

5. The lighting fixture of claim 4, wherein said first V-shaped edge extends from said lower edge and is positioned below said ceiling line and lodges against said flared lamp shield of said housing, said reflector further comprising:

a second V-shaped edge on said reflector opposite said first V-shaped edge extending from said parabola section.

6. A wall wash recessed light fixture having a kick reflector designed to illuminate an adjacent wall up to the joinder of the ceiling and the adjacent wall, comprising:

a housing capable of being installed behind a ceiling and retaining a lamp, said lamp substantially surrounded by a reflector, said reflector mounted within said housing and having an elliptical section substantially surrounding said lamp and a parabolic section tailing away from said elliptical section, said reflector installed within said housing, said recessed light fixture installed within a ceiling;

said recessed light fixture having a flared lamp shield extending below said ceiling, said elliptical section of said reflector having a lower edge positioned below said lamp and extending to said flared lamp shield;

wherein said lower edge of said elliptical section reflects light inclusive of an angle parallel to said ceiling due to said lower edge extending below said ceiling for illumination of the joinder of the ceiling and the adjacent illuminated wall.

7. The lighting fixture of claim 6, wherein said reflector includes a first V-shaped edge positioned below said ceiling against said flared lamp shield of said housing.

* * * * *

UNITED STATES PATENT AND TRADEMARK OFFICE

CERTIFICATE OF CORRECTION

PATENT NO. : 7,607,794 B1
APPLICATION NO. : 11/465609
DATED : October 27, 2009
INVENTOR(S) : Paul Thompson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 243 days.

Signed and Sealed this

Twelfth Day of October, 2010

David J. Kappos

David J. Kappos
*Director of the United States Patent and Trademark Office*